US005370180A

United States Patent [19]

Barbee

[11] Patent Number: 5,370,180

[45] Date of Patent: Dec. 6, 1994

[54] DOWNHOLE OIL AND GAS WELL JACKING TOOL FOR USE WITH COIL TUBING UNIT

[76] Inventor: Phil Barbee, P.O. Box 2005, Gretna, La. 70054-2005

[21] Appl. No.: 160,898

[22] Filed: Dec. 2, 1993

[51] Int. Cl.[5] ..... E21B 23/00

[52] U.S. Cl. ..... 166/178

[58] Field of Search ..... 166/178, 98, 99, 301; 175/296, 299

[56] References Cited

U.S. PATENT DOCUMENTS 3,343,606 9/1967 Dollison ..... 166/178
4,361,195 11/1982 Evans ..... 166/178 X
5,066,060 11/1991 Cooksey et al. ..... 166/178 X
5,232,060 8/1993 Evans ..... 166/178 X

*Primary Examiner*—Michael Powell Buiz
*Attorney, Agent, or Firm*—Pravel, Hewitt, Kimball & Krieger

[57] ABSTRACT

A coil tubing supported jacking tool can be used to remove articles that are stuck in an oil and gas well casing bore. The coil tubing unit transmits pressurized fluid to the tool body. At its lower end, the tool body grips the stuck article. A piston chamber expands to set slips for anchoring the tool body to the well casing. The piston then moves upwardly away from the slips, pulling the stuck article free.

10 Claims, 4 Drawing Sheets

DOWNHOLE OIL AND GAS WELL JACKING TOOL FOR USE WITH COIL TUBING UNIT

BACKGROUND OF THE INVENTION

1. Field Of The Invention

The present invention relates to downhole oil and gas well tools and more particularly relates to a jacking apparatus that can be used in a downhole oil well environment when supported upon the free end of a length of coil tubing that is wound upon a spool at the wellhead area. Even more particularly, the present invention relates to an improved downhole oil well tool that can be used to remove objects that are stuck in the oil well by generating a lifting or jacking force through pressurized fluid applied to a piston after slips or wedges anchor the tool body to the wall of a casing so that the lifting energy is transmitted to the casing rather than solely to the coil tubing unit.

2. General Background

In the drilling and production of oil and gas wells, it is often a problem to complete a well because an object such as a downhole oil well tool or instrument has become stuck in the well. Once these objects are stuck, they often require considerable force for removal. This a is problem in restricted environments wherein the well bore is very small in diameter. Often times, a coil tubing unit can be used to reach restricted portions of a well. However, the lifting power of a coil tubing unit is somewhat restricted because of the small diameter (and small wall thickness) of coil tubing.

SUMMARY OF THE PRESENT INVENTION

The present invention provides an improved oil and gas well tool in the form of a lifting or jacking tool for retrieving articles that are stuck downhole in the well bore of an oil and gas well as defined by an elongated vertically oriented well casing.

The apparatus includes a coil tubing unit having a reel at the earth's surface with coil tubing wound thereon, and with a free end that can pay into the bore of the oil and gas well, wherein the coil tubing is a bore for conveying fluids from the earth's surface to the well bore.

A tool body provides an upper end portion that connects to the free end of the coil tubing.

The tool body provides a lower end portion that forms a connection during use with the article to be retrieved.

The tool body includes an elongated mandrel having a central longitudinal bore that communicates with the bore of the coil tubing.

Slips or wedge members are carried by the tool body for anchoring the tool body to the casing portion of the well bore.

A piston is concentrically placed about the mandrel for moving the slips between engaged and disengaged positions. A hydraulic chamber is positioned between the mandrel and the piston for moving the piston relative to the mandrel.

The slips are positioned on the tool body so that the position of the piston is fixed relative to the casing once the slips anchor the tool body to the casing of the well bore.

After the slips are anchored to the casing, the mandrel then travels upperwardly relative to the casing when fluid continually expands the chamber to move the piston. This creates a lifting force that is dependant upon hydraulic power generated at the chamber rather than by the lifting strength of the coil tubing unit.

In one embodiment, a number of stacked pistons and corresponding number of hydraulic chambers are provided so that the surface area of the chambers is enlarged to provide greater lifting.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
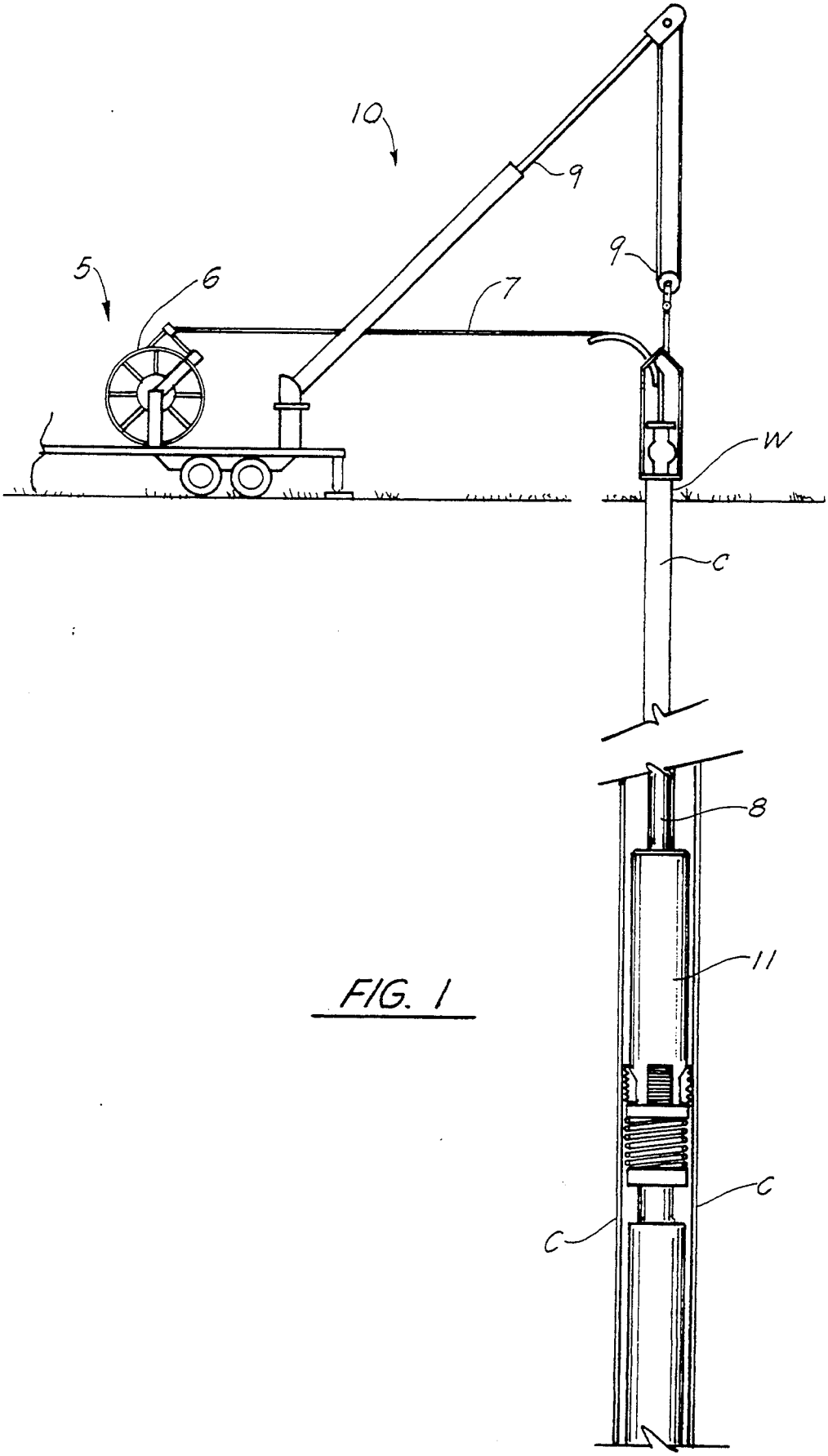
FIG. 1 is a schematic view of the preferred embodiment of the apparatus of the present invention, and illustrating the method of the present invention.

FIGS. 1, 2A–3A and 2B–3B and 4 show the preferred embodiment of the apparatus of the present invention designated generally by the numeral 10. The coil tubing unit includes a reel 6 with coil tubing 7 wound up thereupon. The core tubing 7 has a free end 8 that attaches at a threaded connection for example to tool body 11. Coil tubing units 5 are commercially available devices that generally comprise the reel 6, the wound coil tubing 7, and a coil tubing free end 8 portion. The reel 6 can be trailer mounted as shown. Boom assembly 9 supports the coil tubing as it enters the wellhead W and casing C. Coil tubing 7 is commercially available and typically has a central longitudinal bore for allowing fluids to flow therethrough. Downhole oil well jacking tool 10 includes a tool body 11 having an upper end 12. The bore of Coil tubing 7 communicates with the bore 14 of tool body 11. An upper mandrel section 13 defines the upper end 12 of the tool body 11. External threads 15 provide a place for attachment of a coil tubing unit thereto and specifically for attaching the tool body 11 to the free end of the coil tubing unit.

Second mandrel section 16 has external threads 15 at the upper end portion thereof for forming a connection to the internal thread 17 of upper mandrel section 13.

Second mandrel section 16 has an enlarged lower end portion 19 with an O-ring 18 for forming a seal with the inner surface 21 of first piston 20. Piston 20 has a lower end portion that is enlarged, and which includes an annular shoulder 23 that acts as a stop for movement of piston 20 relative to lower end portion 19 of second mandrel section 16. Shoulder 22 is placed just above cylindrical annular surface 23 at the lower end portion 24 of piston 20. Lower end portion 24 of piston 20 provides an 0-ring seal 26 that forms a seal against inner surface 25 of third mandrel section 32.

Lower end portion 24 includes a transverse end face 27 that butts up against coil spring 23. A hydraulic chamber 30 is defined by the space shown in FIGS. 2A–3A for receiving pressurized fluid as shown by the curved arrow 34 via port 33. Pressurized fluid transmitted to the tool body 11 from the coil tubing is transmitted to the bore 14 and thus communicates with port 33 and chamber 31. This pressurized fluid causes the piston 20 to move away from second mandrel section 16 as shown in FIGS. 3A–3B.

Figure 3A:
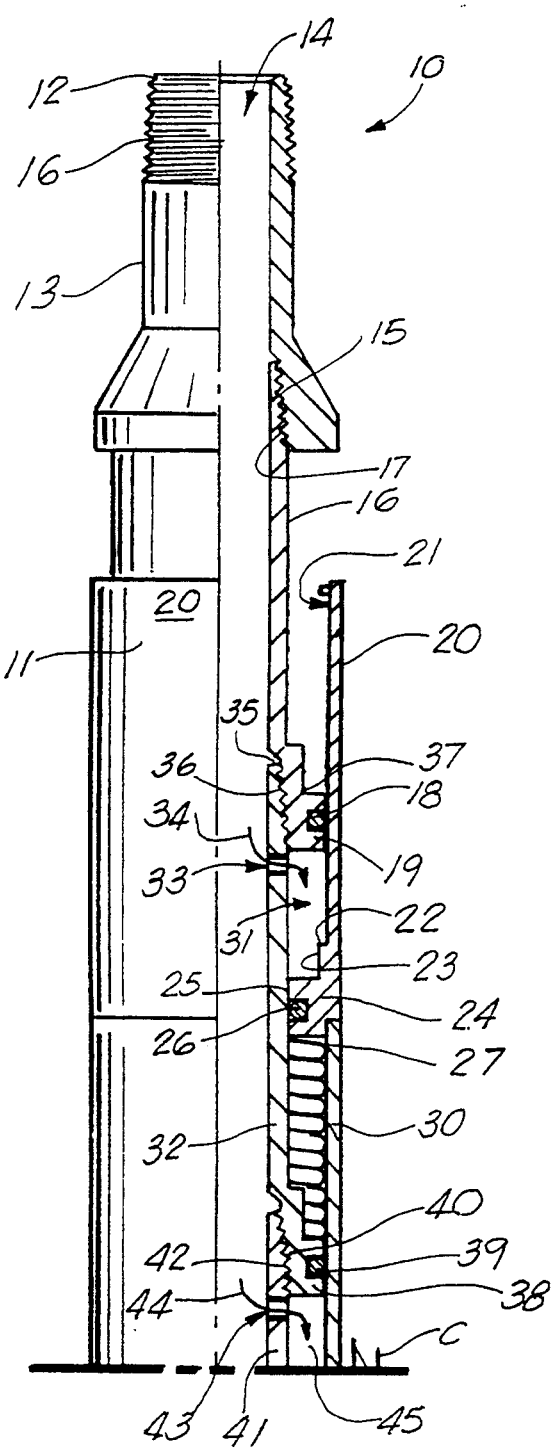
FIG. 3A is a fragmentary sectional view of the preferred embodiment of the apparatus of the present invention shown in a locked position.
Figure 2A:
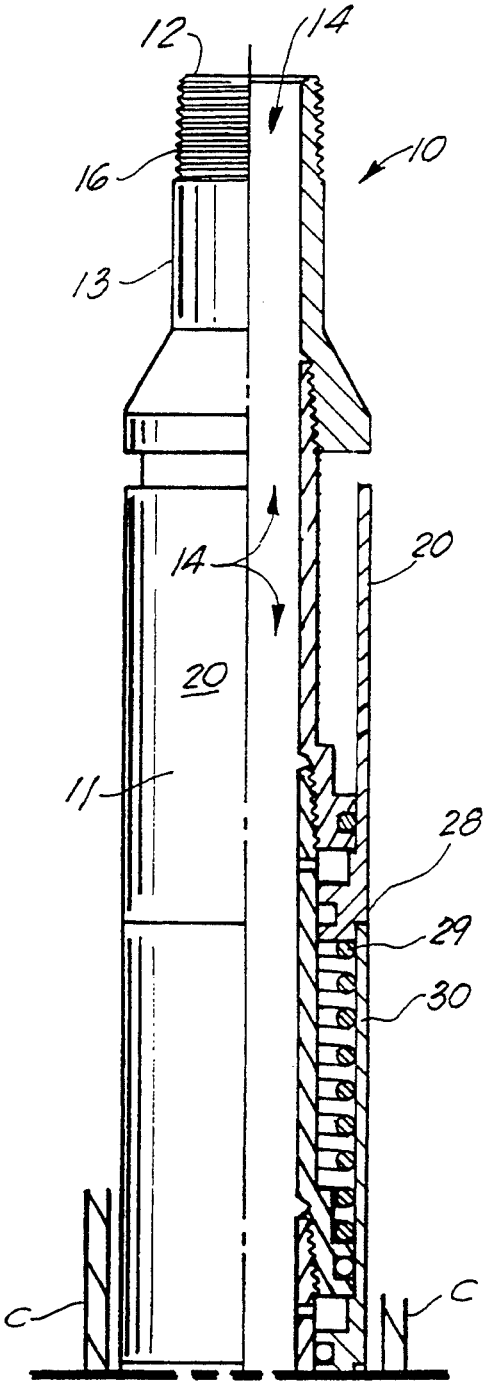
FIG. 2A is a fragmentary elevational view of the preferred embodiment of the apparatus of the present invention shown in a released position.
Figure 3B:
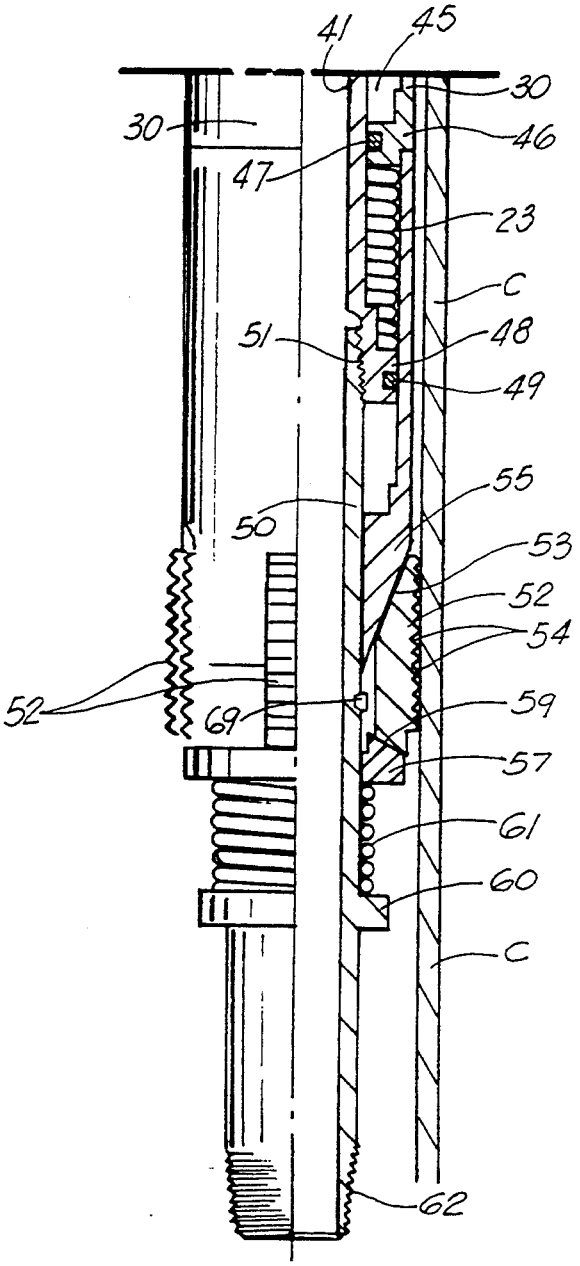
FIG. 3B is a fragmentary elevational view of the preferred embodiment of the apparatus of the present invention showing the tool body in a locked position.
Figure 2B:
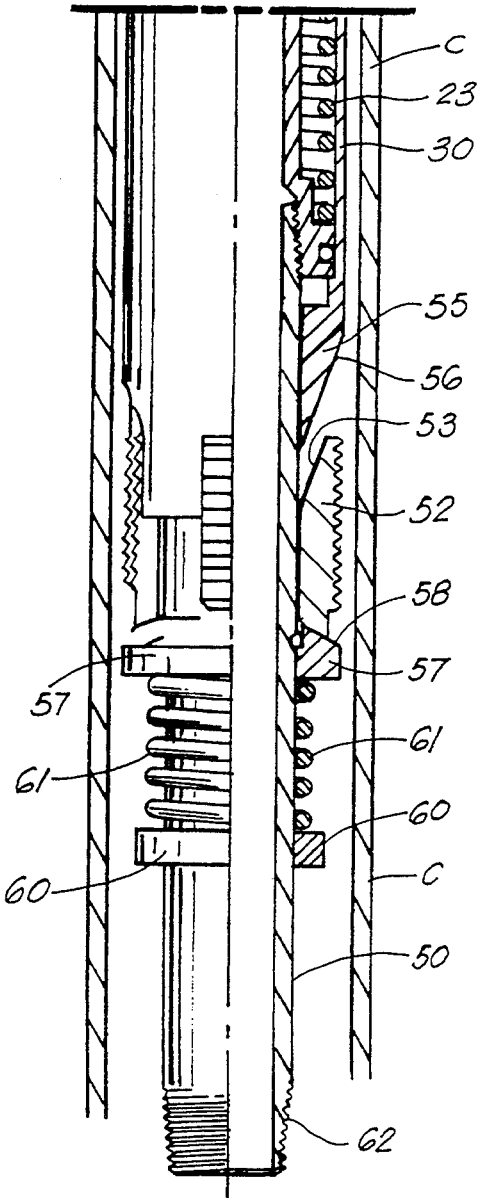
FIG. 2B is a fragmentary view of the preferred embodiment of the apparatus of the present invention showing the tool body in released position.
Figure 4:
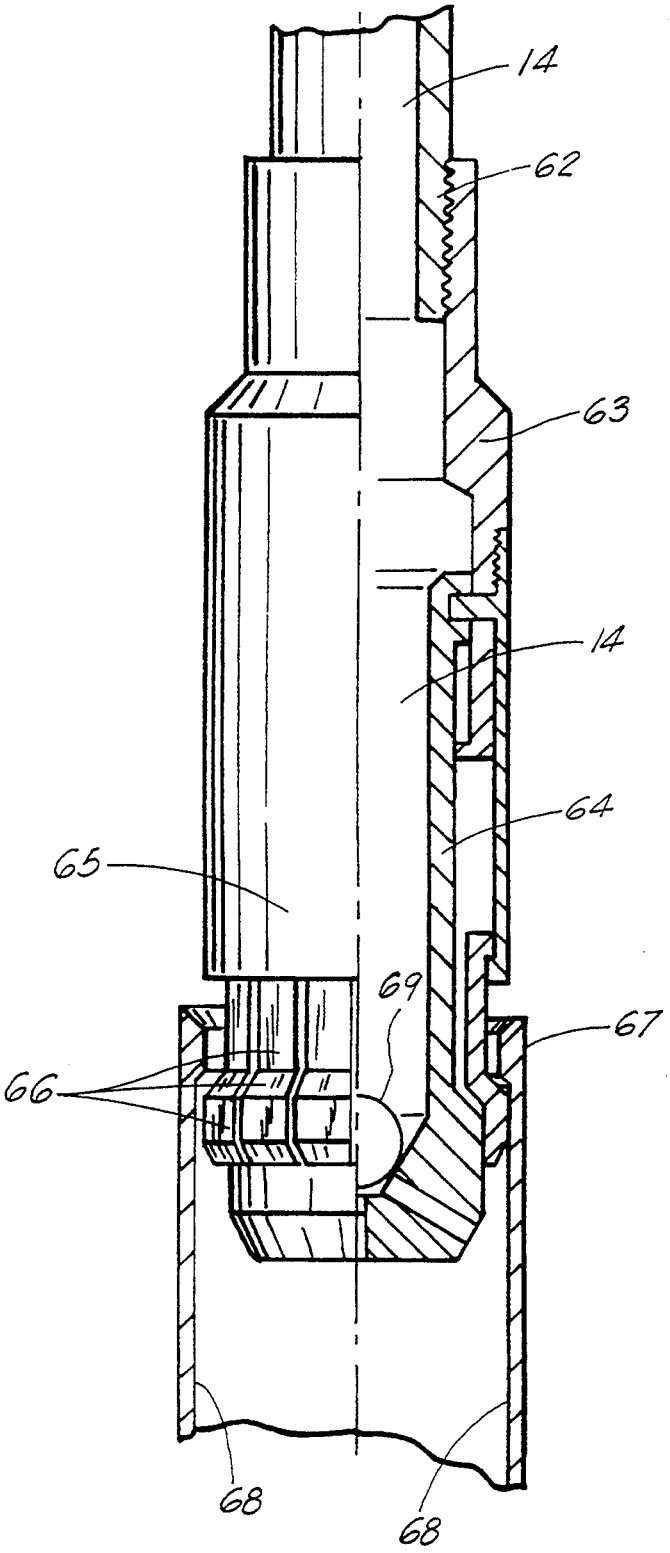
FIG. 4 is a sectional fragmentary elevational view of the preferred embodiment of the apparatus of the present invention illustrating the lower end portion of the tool as attached to an article to be retrieved from the well bore.

Likewise, a second port 43 receives pressurized fluid from the bore 14 as shown by arrow 44 in FIG. 3A. The upper end portion 35 of third mandrel section 32 forms a threaded connection at external threads 36 with the internal threads 37 of lower end portion 19 of second mandrel section 16.

Third mandrel section 32 provides a lower end portion 38 with an O-ring seal 39 for forming a seal with second piston 30. Lower end portion 38 provides internal threads 40 that form a threaded connection with external threads 32 of fourth mandrel section 41. The two hydraulic chambers 31 and 45 thus simultaneously receive pressurized fluid from bore 14 of tool body 11. This provides twice as much force for lifting an article to be retrieved once the tool body 11 is anchored to the casing "c" using the plurality of slips 52.

The lower end portion 46 of second piston 30 has an O-ring seal 47 for forming a seal with fourth mandrel section 41. Fifth mandrel section 50 attaches to the lower end portion 48 of fourth mandrel section 41 at threaded connection 51. Below lower end portion 46 of second piston 30, a plurality of wedged slips 52 are circumferentially spaced about tool body 11. Each of the slips 52 provides teeth 54 for biting into the casing C as shown in FIG. 3B.

When the lower end 55 of piston 30 moves down responsive to an introduction of fluid under pressure into ports 33 and 43, inclined surface 56 engages the inclined surface 53 of wedge slips 52. The wedge slips 52 also engage the inclined surface 58 of annular ring 57.

Ring 57 is supported from below by coil spring 61 which bottoms upon annular flange 60. Upward movement of ring 57 is prevented beyond stop 69. The slips 52 move outwardly to engage casing "C" as shown in FIG. 3B. The ring 57 moves downwardly toward flanged portion 61, compressing spring 61.

This construction provides a smooth, even distribution of load to the plurality of slips 53 so that the wedge shaped slip members each evenly engage the casing "C" creating a load transfer surface between the plurality of slip members 52 and the casing "C". However, continued introduction of fluid under pressure into the chambers 31 and 45 causes relative movement of the plurality of mandrel sections 13, 16, 32, 41, and 50 upwardly. As the fluid enters the chambers 31, 45 each of the chambers 31, 45 expands, pushing the mandrels upwardly. This also raises the lower, threaded end 62 of the tool body 11 and the stuck article 68.

The article 68 is connected to a plurality of fingers 66 depending from tool body section 65. The fingers 66 engage a fishing neck 67. Lower end 62 forms a connection with slack joints 63, 64. As the lower end portion 62 travels upwardly, the stuck article 68 also moves upwardly. Slack joints 63, 64 are commercially available devices that allow downward motion in order to recock or reload the jacking apparatus 10. This sphere 69 seals the tool bore 14 after the fingers 66 grip neck 67. The sphere 69 can be dropped from the wellhead area via the bore of the coil tubing unit.

The following table lists the part numbers and part descriptions as used herein and in the drawings attached hereto.

PARTS LIST

| Part Number | Description |
|---|---|
| 5 | coil tubing unit |
| 6 | reel |
| 7 | coil tubing |
| 8 | free end |
| 9 | boom assembly |
| 10 | downhole oil well jacking tool |
| 11 | tool body |
| 12 | upper end |
| 13 | upper mandrel section |
| 14 | bore |
| 15 | external threads |
| 16 | second mandrel section |
| 17 | internal threads |
| 18 | O-rings |
| 19 | lower end portion |
| 20 | first piston |
| 21 | inner surface |
| 22 | annular shoulder |
| 23 | coil spring |
| 24 | lower end portion |
| 25 | inside annular face |
| 26 | O-ring seal |
| 27 | end face |
| 28 | annular shoulder |
| 29 | cylindrical surface |
| 30 | second piston |
| 31 | chamber |
| 32 | third mandrel section |
| 33 | port |
| 34 | arrow |
| 35 | upper end portion |
| 36 | external threads |
| 37 | internal threads |
| 38 | lower end portion |
| 39 | O-ring seal |
| 40 | internal threads |
| 41 | fourth mandrel section |
| 42 | external threads |
| 43 | port |
| 44 | arrow |
| 45 | chamber |
| 46 | lower end portion |
| 47 | O-ring seal |
| 48 | lower end portion |
| 49 | O-ring seal |
| 50 | fifth mandrel section |
| 51 | threaded connection |
| 52 | wedge member |
| 53 | inclined surface |
| 54 | teeth |
| 55 | lower end portion |
| 56 | inclined surface |
| 57 | annular ring |
| 58 | annular beveled surface |
| 59 | annular beveled surface |
| 60 | annular flanged portion |
| 61 | coil spring |
| 62 | threaded end |
| 63 | slack joint section |
| 64 | slack joint section |
| 65 | spear type grab |
| 66 | fingers |
| 67 | fishing neck |
| 68 | stuck "fish" |
| 69 | sphere |
| C | casing |
| W | wellhead |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as the invention is:

1. An oil and gas well downhole jacking tool for retrieving articles that are stuck in the well bore of a downhole oil and gas well that is defined by a well casing, comprising:

a) a coil tubing unit having a reel at the earths surface with coil tubing wound thereon and a free end that can pay into the bore of the oil and gas well, wherein the coil tubing has a bore for conveying fluids from the earth's surface area to the well bore;

b) a tool body having an upper end portion with means for forming a connection with the free end of the coil tubing;

c) the tool body having a lower end portion with means for forming a connection with the article to be retrieved;

d) the tool body including an elongated mandrel having a central longitudinal bore that communicates with the bore of the coil tubing;

e) slip means carried by the tool body for anchoring the tool body to the casing of the well bore;

f) piston means, concentrically positioned about the mandrel for moving the slip means between engaged and disengaged positions;

g) fluid operable chamber means positioned between the mandrel and the piston means for moving the piston means relative to the mandrel responsive to the introduction of pressurized fluid into the central longitudinal bore;

h) the slip means being positioned on the tool body so that position of the piston is fixed relative to the casing once the slip means anchors the tool body to the casing of the well bore; and i) wherein the mandrel travels upwardly relative to the casing when fluid expands the chamber to move the piston after the slip means anchors the tool body to the casing wall.

2. The apparatus of claim 1 wherein the chamber means comprises in part an annular chamber.

3. The apparatus of claim 1 wherein the chamber means comprises multiple chambers at spaced apart locations on the tool body.

4. The apparatus of claim 1 wherein the piston means includes multiple connectable piston sections.

5. The apparatus of claim 1 wherein the mandrel comprises multiple mandrel sections.

6. The apparatus of claim 1 port means extending through the mandrel for communication of fluid between the mandrel bore and the chamber means.

7. The apparatus of claim 6 wherein the port means comprises multiple ports.

8. The apparatus of claim 1 wherein the piston means includes a generally cylindrically shaped piston.

9. The apparatus of claim 1 wherein the mandrel comprises a plurality of generally cylindrically shaped mandrels.

10. An oil and gas well downhole jacking tool for retrieving articles that are stuck in the well bore of a downhole oil and gas well that is defined by a well casing, comprising a) a coil tubing unit having a reel at the earth's surface with coil tubing wound thereon and a coil tubing free end that can pay into the bore of the oil and gas well, wherein the coil tubing has a tubing bore for conveying fluids from the earth's surface area to the well bore;

b) a tool body having an upper end portion that is connected during use with the free end of the coil tubing;

c) the tool body having a lower end portion that removably connects during use with the article to be retrieved;

d) the tool body including an elongated mandrel having a central longitudinal bore that communicates with the bore of the coil tubing;

e) a plurality of slips carried by the tool body for anchoring the tool body to the casing of the well bore;

f) a piston that is concentrically positioned about the mandrel for moving the slips between engaged and disengaged positions;

g) a fluid receptive chamber, expandable positioned between the mandrel and the piston for moving the piston relative to the mandrel;

h) the slips being positioned on the tool body so that position of the piston is fixed relative to the casing once the slips anchor the tool body to the casing of the well bore; and i) wherein the mandrel travels upwardly relative to the casing when fluid expands the chamber to move the piston after the slips anchor the tool body to the casing wall.

* * * * *